US009455542B2

(12) United States Patent
Gaither

(10) Patent No.: US 9,455,542 B2
(45) Date of Patent: Sep. 27, 2016

(54) POWER CORD APPARATUS AND METHOD OF USING SAME

(71) Applicant: Wayne Gaither, Charlotte, NC (US)
(72) Inventor: Wayne Gaither, Charlotte, NC (US)

( * ) Notice: Subject to any disclaimer, the term of this patent is extended or adjusted under 35 U.S.C. 154(b) by 320 days.
(21) Appl. No.: 14/087,290
(22) Filed: Nov. 22, 2013
(65) Prior Publication Data
US 2014/0148047 A1 May 29, 2014
Related U.S. Application Data
(60) Provisional application No. 61/796,887, filed on Nov. 23, 2012.
(51) Int. Cl.
*H01R 31/06* (2006.01)
(52) U.S. Cl.
CPC ..... *H01R 31/06* (2013.01)
(58) Field of Classification Search
CPC ..... H01R 31/06
See application file for complete search history.

(56) References Cited

U.S. PATENT DOCUMENTS 1,967,021 A * 7/1934 Gary ..... H01R 13/62 439/469
2,989,719 A * 6/1961 Aarlaht ..... H01R 27/00 439/103
4,053,788 A * 10/1977 Robie ..... G03G 15/80 307/11
4,386,333 A * 5/1983 Dillan ..... H01F 29/00 323/328
4,815,983 A * 3/1989 Erickson ..... H01R 27/00 439/172
4,900,270 A * 2/1990 Edwards ..... H01R 31/06 439/173
5,213,516 A * 5/1993 Okamoto ..... H01R 13/652 439/104
5,395,264 A * 3/1995 Keith ..... H01R 31/06 439/502
5,423,690 A * 6/1995 Selker ..... H01R 31/06 439/172
5,634,806 A * 6/1997 Hahn ..... H01R 27/00 439/172
6,022,237 A * 2/2000 Esh ..... H01R 13/5219 439/348
6,227,888 B1 * 5/2001 Hahn ..... H01R 27/00 439/172
7,040,931 B1 * 5/2006 Achtner ..... H01R 9/11 439/103
7,510,429 B1 * 3/2009 Savicki, Jr. ..... H01R 25/003 174/53
8,647,131 B1 * 2/2014 Wiebusch ..... H01R 31/06 439/170
2002/0190042 A1 * 12/2002 Gadamus ..... B23K 9/1006 219/130.1
2006/0118533 A1 * 6/2006 Yunk ..... B23K 9/32 219/130.1
2006/0221558 A1 * 10/2006 Sutton ..... B60R 16/0207 361/600
2010/0317222 A1 * 12/2010 Tom ..... H01R 13/652 439/490
2011/0039435 A1 * 2/2011 Huang ..... H01R 27/00 439/218
2011/0065305 A1 * 3/2011 Amit ..... B60L 11/005 439/368

(Continued)

*Primary Examiner* — James Harvey
(74) *Attorney, Agent, or Firm* — Ashley Law Firm P.C.; Stephen S. Ashley, Jr.

(57) ABSTRACT

A power cord apparatus includes a first body section having at least one power prong, and a head section having at least one receptacle for receiving the power prong. The power prong has a first section adapted for insertion into a hot slot of an electrical outlet, and a second section adapted for engaging a complimentary member operatively connected to a hot wire of an electrical cord. A neutral prong is carried on the body section. The neutral prong a first section adapted for insertion into the neutral slot of an electrical outlet, and a second section adapted for engaging a complimentary member operatively connected to a neutral wire of an electrical cord.

14 Claims, 13 Drawing Sheets

(56) References Cited

U.S. PATENT DOCUMENTS

2012/0220148 A1* 8/2012 Walls, Jr. ..... H01R 31/06 439/218
2012/0220167 A1* 8/2012 Walls, Jr. ..... H01R 31/06 439/638
2012/0289074 A1* 11/2012 Chang ..... H01R 13/627 439/325
2013/0094154 A1* 4/2013 Shen ..... H01R 13/502 361/731
2013/0300201 A1* 11/2013 Wu ..... H01R 25/003 307/82
2014/0033531 A1* 2/2014 Griffith ..... H01R 31/06 29/876
2014/0065886 A1* 3/2014 Lee ..... H01R 27/02 439/628
2014/0099808 A1* 4/2014 McClelland ..... H01R 13/6205 439/153
2014/0139175 A1* 5/2014 Gonzalez ..... F02N 11/12 320/101
2014/0148047 A1* 5/2014 Gaither ..... H01R 31/06 439/518
2014/0273645 A1* 9/2014 Glick ..... H01R 31/06 439/628

* cited by examiner

POWER CORD APPARATUS AND METHOD OF USING SAME

CROSS-REFERENCE TO RELATED APPLICATIONS

This application claims priority to U.S. Provisional Patent Application No. 61/796,887 filed Nov. 23, 2012, which is incorporated herein by reference.

TECHNICAL FIELD AND BACKGROUND OF THE INVENTION

The present invention relates to a power cord apparatus, and a method of using such an apparatus. One embodiment of the invention comprises a power cord apparatus adapted for use with dryers and stoves.

Electrical power outlets are constructed in a variety of configurations. For example, the outlets for large household appliances such as stoves and electric clothes dryers have a variety of configurations, each one typically requiring a particular design of power cord that corresponds to the particular outlet. The power outlets for clothes dryers are constructed in four different design configurations—two different configurations utilizing four prongs and two other configurations utilizing three prongs.

Due to the variation in outlet configuration, electric dryers are typically sold without a power cord, and the four different power cords needed for the four different outlet configurations are sold separately. This can be problematic as the purchaser of a new dryer is often unsure of which particular power outlet configuration exists in his home, and at times is not even aware that the dryer being purchased does not include a power cord. Furthermore, regulations require a brand new cord to be installed with each new dryer, even when the purchaser of the new dryer already has a functioning power cord (which was being used with a previous dryer). As such, professional appliance installers often carry a supply of all four different power cords to a particular dryer installation job, and determine which is the appropriate power cord when arriving at the site of installation. However, many consumers are annoyed with having to purchase a separate cord soon after making the significant purchase of a dryer, which can lead to overall customer dissatisfaction with the seller and/or manufacturer of the dryer. Similar problems arise when one moves a dryer from a residence having a particular outlet configuration to another site having a different outlet configuration.

SUMMARY OF THE INVENTION

Therefore, one object of the present invention is to provide an efficient and convenient means for adapting a power cord to fit a variety of different outlets. Another object of the present invention is to provide an apparatus that allows for an appliance such as a electric dryer or stove to be manufactured with an integrally attached power cord that can be used in variety of power outlet configurations. These and other objects of the invention can be achieved in the preferred embodiments of the invention described below.

One embodiment of the invention comprises a power cord apparatus comprising a first body section having at least one power prong carried on the body section. The power prong has a first section adapted for insertion into a hot slot of an electrical outlet, and a second section adapted for engaging a complimentary member operatively connected to a hot wire of an electrical cord. A neutral prong is carried on the body section. The neutral prong has a first section adapted for insertion into the neutral slot of an electrical outlet, and a second section adapted for engaging a complimentary member operatively connected to a neutral wire of an electrical cord.

According to another embodiment of the invention, a grounding prong is carried on the body section. The grounding prong has a first section adapted for insertion into a grounding slot in an electrical outlet, and a second section adapted for engaging a complimentary member operatively connected to a ground wire of an electrical cord.

According to another embodiment of the invention, two power prongs are carried on the body section. Each of the two power prongs include a first section adapted for insertion into a hot slot of an electrical outlet, and a second section adapted for engaging a complimentary member operatively connected to a hot wire of an electrical cord.

According to another embodiment of the invention, the two power prongs are positioned on the body section above the neutral prong, and the apparatus is adapted for use with a three prong electrical outlet.

According to another embodiment of the invention, a grounding prong is carried on the body section. The grounding prong includes a first section adapted for insertion into a grounding slot in an electrical outlet, and a second section adapted for engaging a complimentary member operatively connected to a ground wire of an electrical cord, wherein the apparatus is adapted for use with a four prong electrical outlet.

According to another embodiment of the invention, the neutral prong is positioned on the body section above the two power prongs.

According to another embodiment of the invention, the two power prongs are positioned on the body section above the grounding prong.

According to another embodiment of the invention, the first body section is substantially flat and has first and second opposed sides. The power prongs, the neutral prong and the grounding prong extend through the body section. The first sections of the power prongs, the neutral prong and the grounding prong extend outward from the first side of the body section. The second sections of the power prongs, the neutral prong and the grounding prong extend outward from the second side of the body section.

According to another embodiment of the invention, the power cord apparatus includes a second body section having at least one power receptacle adapted for receiving the second section of the power prong and operatively connected to a hot wire of an electrical cord. The second body section includes a neutral receptacle adapted for receiving the second section of the neutral prong and operatively connected to a neutral wire of an electrical cord. The first body section and the second body section are operatively connected to each other by positioning the second section of the power prong into the power receptacle and positioning the neutral prong into the neutral receptacle.

According to another embodiment of the invention, a grounding prong is carried on the first body section. The grounding prong includes a first section adapted for insertion into a grounding slot in an electrical outlet, and a second section adapted for engaging a complimentary member operatively connected to a ground wire of an electrical cord. The second body section comprises a grounding receptacle operatively connected to a ground wire of an electrical cord and is adapted for receiving the second section of the grounding prong.

According to another embodiment of the invention, the power cord apparatus includes first and second power prongs carried on the first body section, and each of the first and second power prongs include a first section adapted for insertion into a hot slot of an electrical outlet, and a second section adapted for engaging a complimentary member operatively connected to a hot wire of an electrical cord. The power cord apparatus includes first and second power receptacles, the first receptacle adapted for receiving the second section of the first power prong and the second receptacle adapted for receiving the second section of the second power prong.

According to another embodiment of the invention, the second body section includes an upper portion and a base portion extending substantially perpendicularly from the upper portion. The power receptacle and the neutral receptacle are positioned in the upper portion.

According to another embodiment of the invention, the first body section includes a substantially rectangular upper portion and a base member extending downwardly from a lower edge of the upper portion. The base portion of the second body section includes a cavity shaped and sized to receive the base member of the first body section therein, such that the second body section can support the first body section.

According to another embodiment of the invention, a power cord apparatus comprises at least one hot wire adapted for conducting electricity to a load and a neutral wire adapted for conducting electricity back to a power source. Each of the wires has a first end for connecting to the load and a second end opposite the first end. A head section comprises at least one hot receptacle operatively connected to the hot wire and is adapted for receiving a hot prong member operatively connected to the power source and conducting electricity received therefrom to the hot wire. A neutral receptacle is operatively connected to the neutral wire and adapted to receive a neutral prong member connected to the power source.

According to another embodiment of the invention, the at least one hot wire comprises first and second hot wires, and further wherein the at least one power receptacle comprises first and second hot receptacles, the first hot receptacle operatively connected to the first hot wire and adapted for receiving a first hot prong member and the second hot receptacle operatively connected to the second hot wire and adapted for receiving a second hot prong member.

According to another embodiment of the invention, the power cord apparatus includes a ground wire adapted for providing a path for stray electricity, and the head section includes a grounding receptacle operatively connected to the ground wire and adapted for receiving a grounding prong member.

According to another embodiment of the invention, the load is an electric appliance, and the power source is an electrical wall outlet.

According to another embodiment of the invention, engagement members are positioned at the first ends of the wires and adapted for frictionally engaging receptacles of an appliance power block and operatively connecting the wires to the power block.

According to another embodiment of the invention, the power cord apparatus includes a face section comprising at least one hot conductor prong having a first section adapted for insertion into a hot slot of an electrical outlet, and a second section adapted for insertion into the hot receptacle on the head section. The face section can include a neutral conductor prong having a first section adapted for insertion into a neutral slot of an electrical outlet, and a second section adapted for insertion into the neutral receptacle on the head section.

Another embodiment of the invention comprises a power cord kit comprising at least one hot wire adapted for conducting electricity to a load and a neutral wire adapted for conducting electricity back to a power source. Each of the wires has a first end for connecting to the load and a second end opposite the first end. A head section comprises at least one hot receptacle operatively connected to the hot wire and is adapted for receiving a hot prong member operatively connected to the power source and conduct electricity received therefrom to the hot wire. A neutral receptacle is operatively connected to the neutral wire and adapted to receive a neutral prong member connected to the power source. At least one face section comprises at least one hot conductor prong having a first section adapted for insertion into a hot slot of an electrical outlet, and a second section adapted for insertion into the hot receptacle on the head section. A neutral conductor prong comprises a first section adapted for insertion into a neutral slot of an electrical outlet, and a second section adapted for insertion into the neutral receptacle on the head section.

According to another embodiment of the invention, the power cord kit includes a first face section adapted for engaging a three prong electrical outlet, and a second face section adapted for engaging a four prong electrical outlet.

DESCRIPTION OF THE PREFERRED EMBODIMENTS OF THE INVENTION AND BEST MODE

Figure 1A:
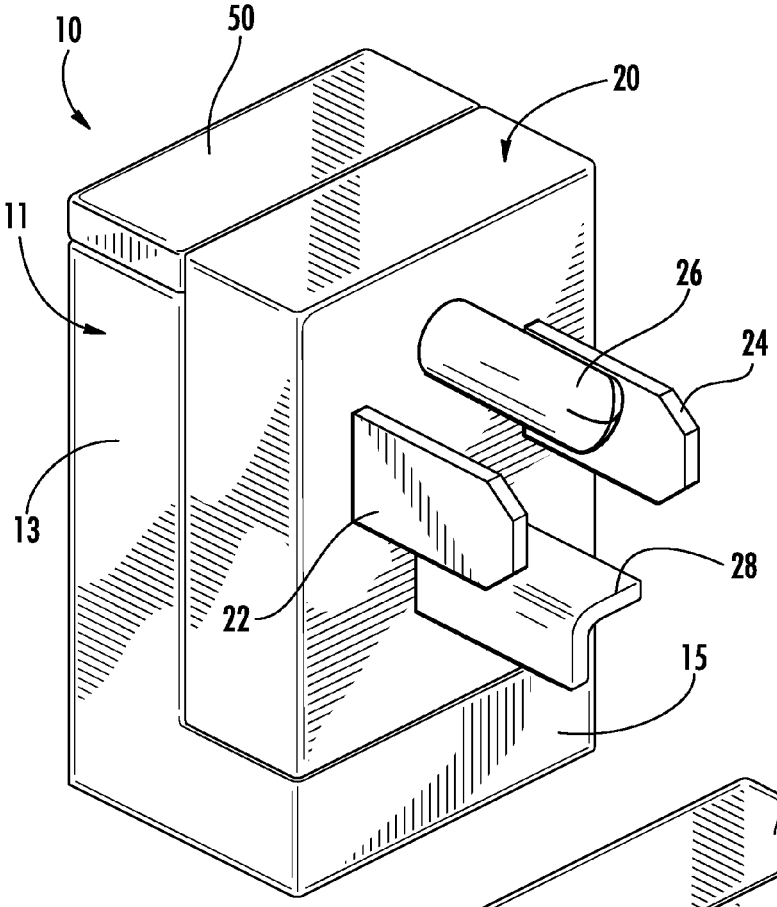
FIG. 1A is a partial perspective view of a power cord apparatus according to a preferred embodiment of the invention.
Figure 1B:
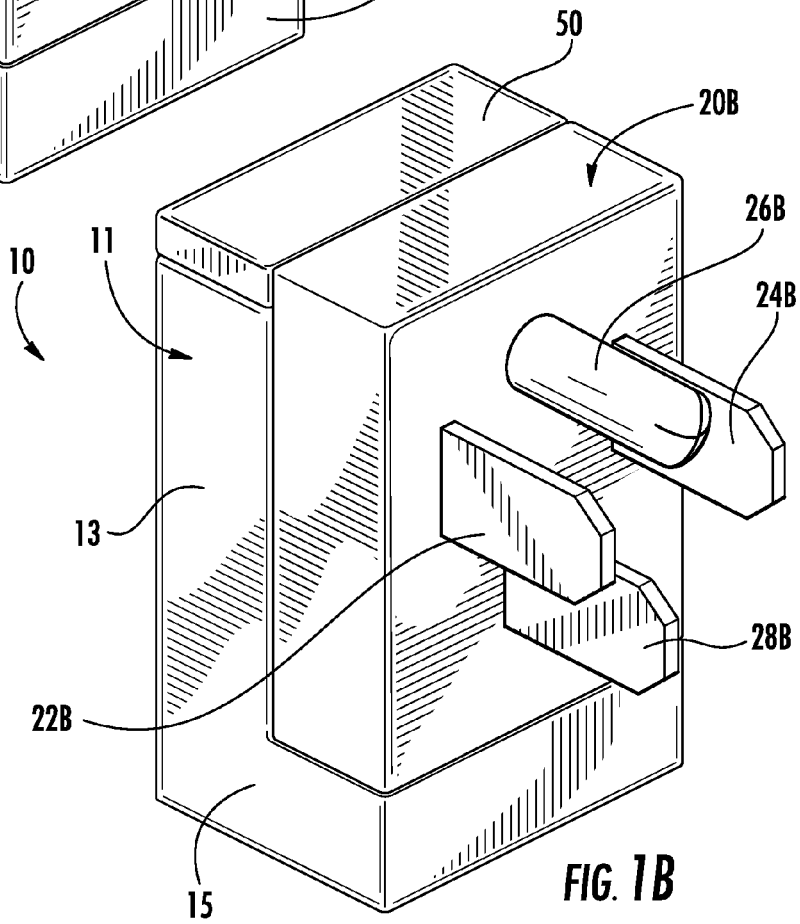
FIG. 1B is another partial perspective view of a power cord apparatus according to a preferred embodiment of the invention.
Figure 1C:
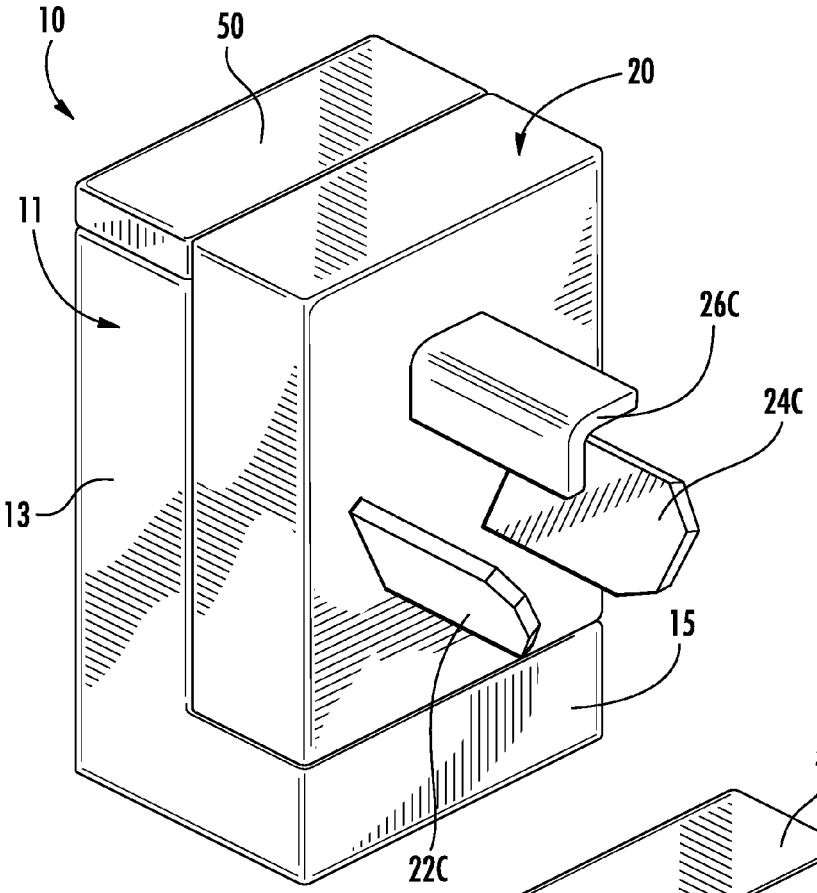
FIG. 1C is a partial perspective view of a power cord apparatus according to a preferred embodiment of the invention.
Figure 1D:
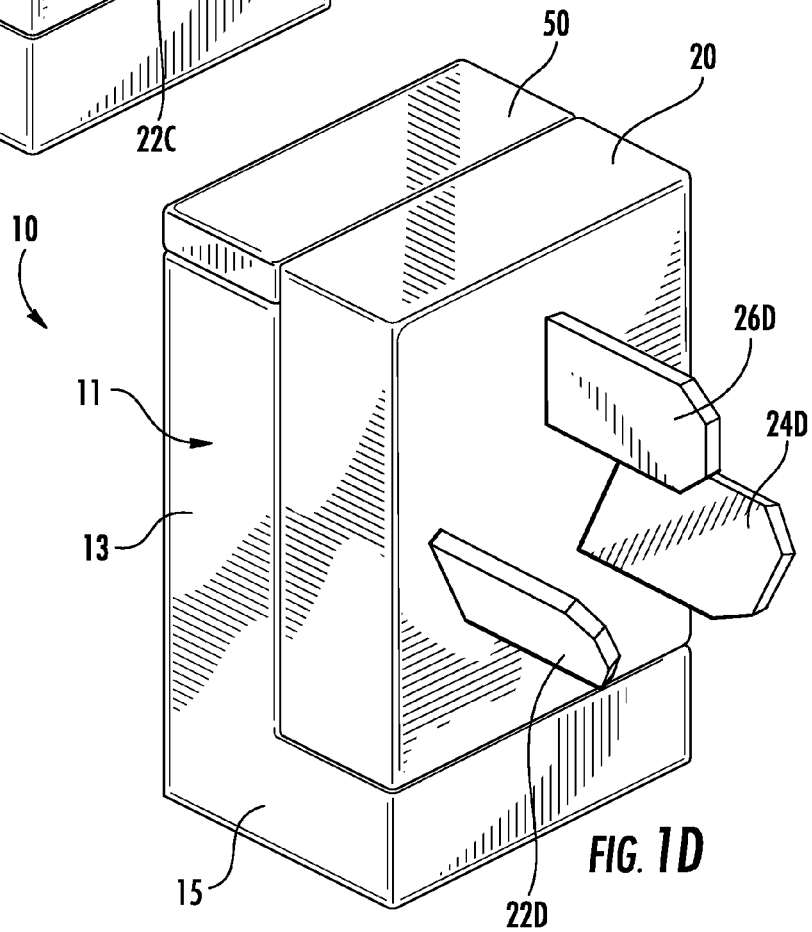
FIG. 1D is a partial perspective view of a power cord apparatus according to a preferred embodiment of the invention.
Figure 2:
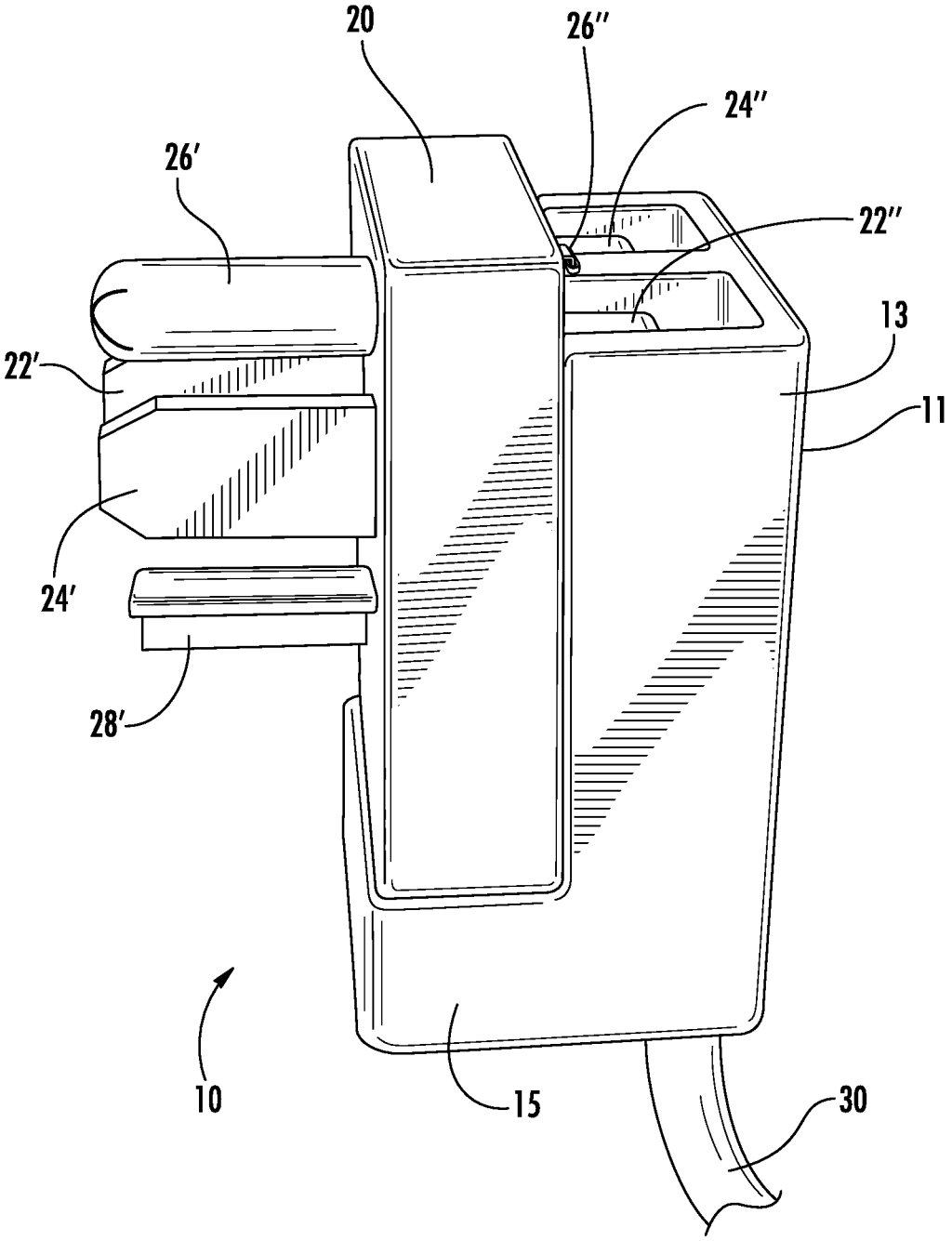
FIG. 2 is another perspective view of the power cord apparatus of FIG. 1A.
Figure 3:
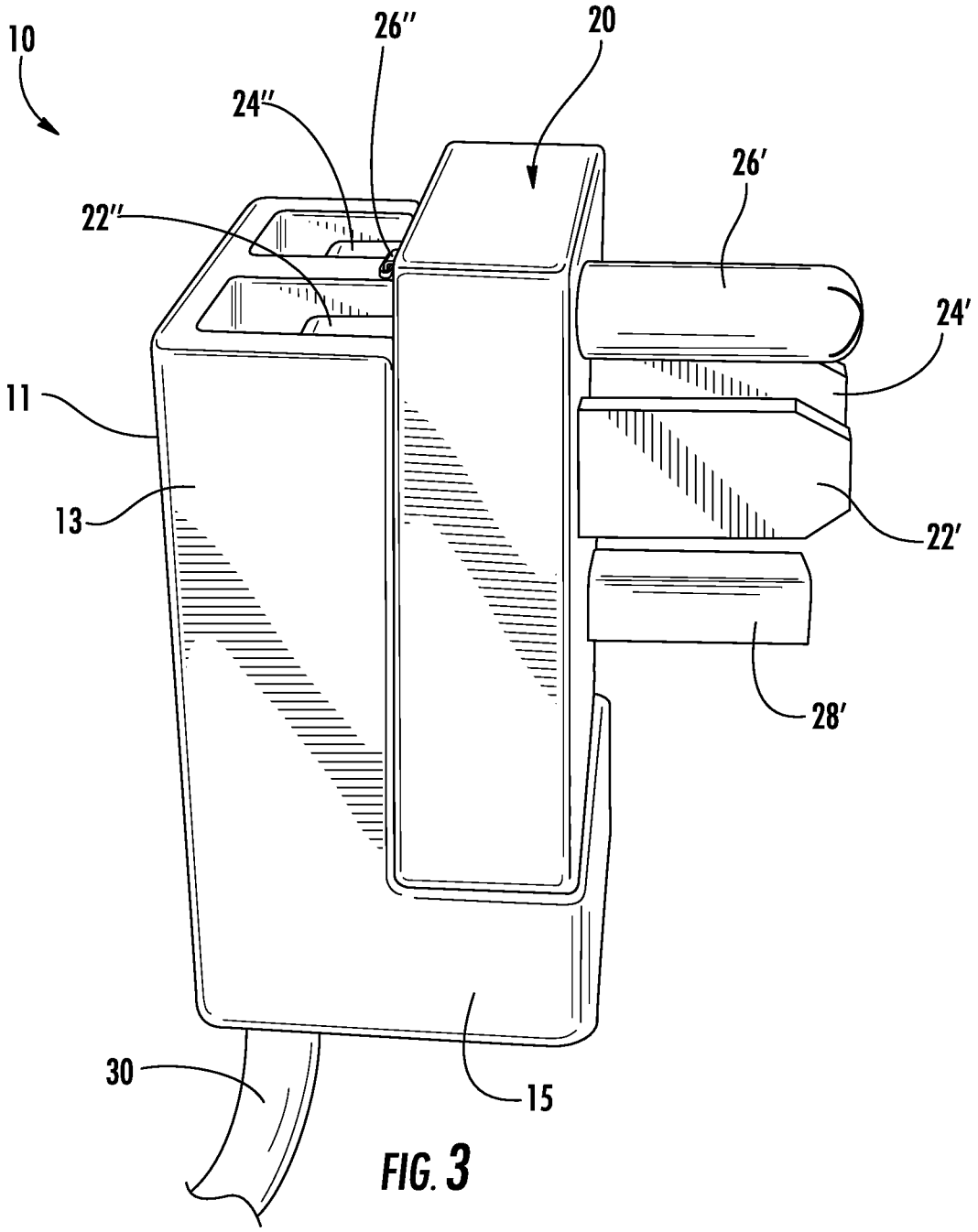
FIG. 3 is another perspective view of the power cord apparatus of FIG. 1A.

A power cord apparatus according to a preferred embodiment of the invention is illustrated in FIGS. 1A-4, and shown generally at reference numeral 10. As shown in FIGS. 2 and 3, the power cord apparatus 10 comprises a head receiving section 11 and a face section 20 that engages the head section 11. The head section 11 and face section 20 comprise housings that can be made of plastic, foam, rubber or other suitable material.

Figure 4:
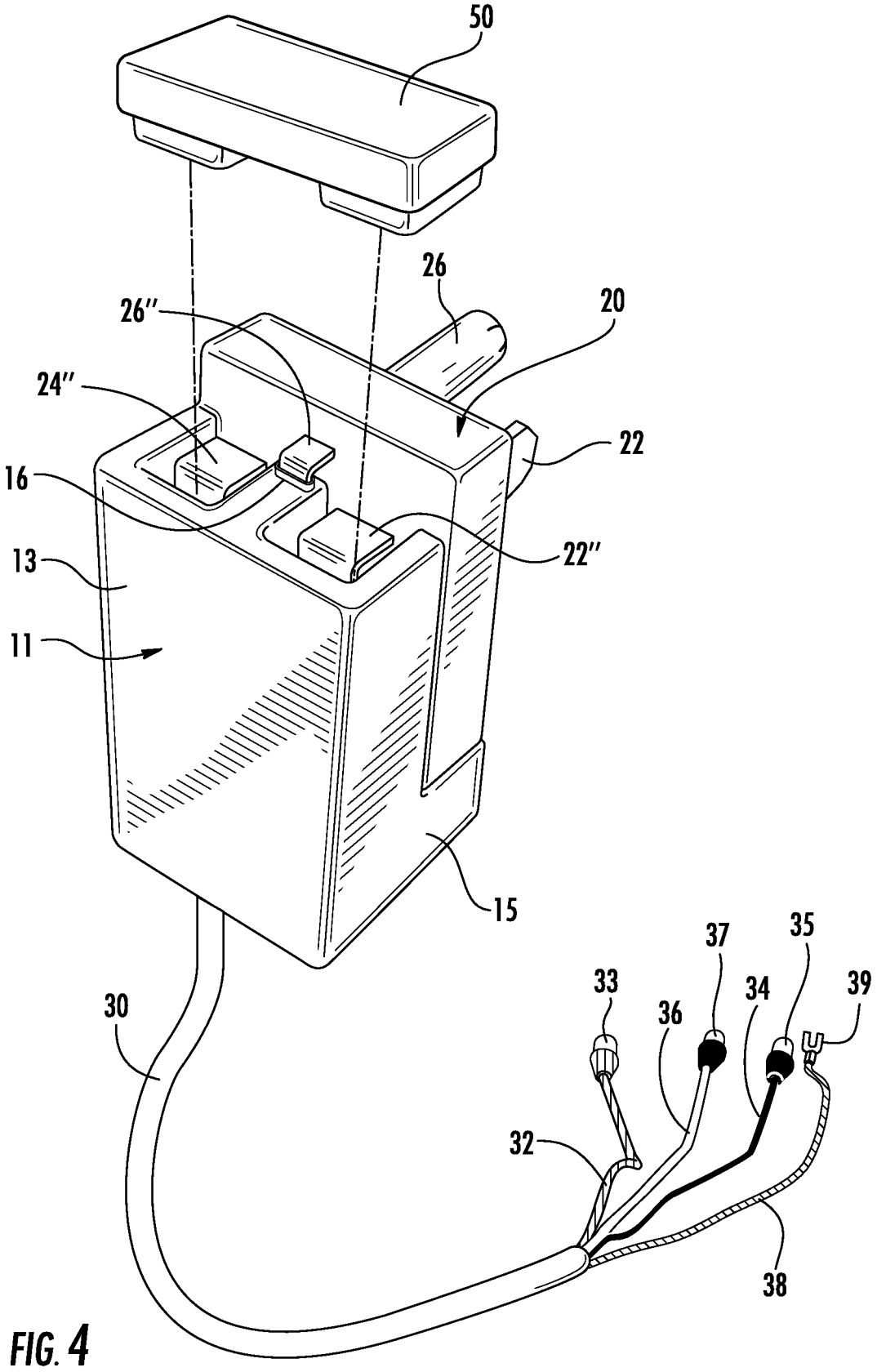
FIG. 4 is another perspective view of the power cord apparatus of FIG. 1A.
Figure 6:
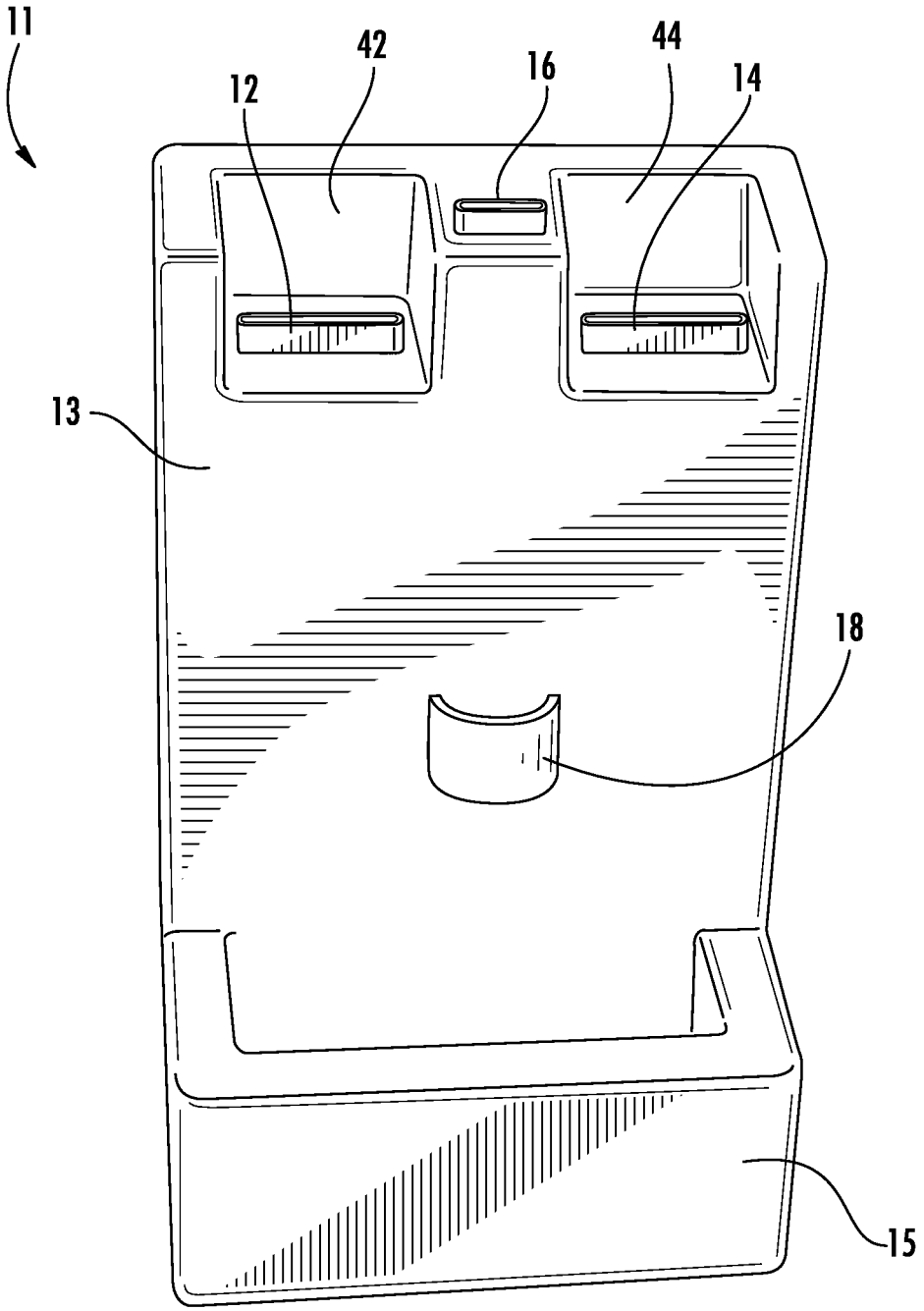
FIG. 6 is a partial perspective view of the power cord apparatus of FIG. 1A.

The head section 11 includes four conductor receptacles 12, 14, 16, 18 comprised of a material that allows for the flow of electricity. Two receptacles 12, 14 are hot (live) receptacles connected to two hot (live) wires 32, 34. The hot wires 32, 34 comprise electrically charged, conductive wires that provide power to a load, such as a household appliance, machine or light bulb. Preferably, the load is an electric dryer or stove. Preferably, one hot wire 32 is covered in black insulation, and the other hot wire 34 is covered in red insulation, as shown in FIG. 4. Each hot wire 32, 34 can supply a current of 120 volts for a total of 240 volts of electricity supplied to the load. As such, the hot wires 32, 34 can supply the necessary electricity for a dryer requiring 240 volts. The hot receptacles 12, 14 are positioned within cavities, 42, 44, respectively, formed at the top of the head section 11, as shown in FIG. 6. Each of the hot receptacles 12, 14 can comprise rectangular metal bodies defining an opening for receiving and engaging a complementary prong member therein.

Another receptacle 16 on the head section 11 is a neutral receptacle connected to a grounded neutral wire 36. The neutral wire 36 conducts electricity back to the power source to complete the circuit. Preferably, the neutral wire 36 is covered in white insulation, as shown in FIG. 4. The neutral receptacle 16 is preferably positioned between the hot receptacles 12, 14 at the top of the head section 11, as shown in FIG. 6. The neutral receptacle 16 can comprise a rectangular metal body that is relatively smaller than the hot receptacles 12, 14.

Yet another receptacle 18 on the head section 11 is a grounding receptacle connected to an equipment grounding conductor wire 38. The equipment grounding wire 38 can be made of copper and provides a low resistance path to ground for stray electrical current. Preferably, the equipment grounding wire 38 is covered with green insulation, as shown in FIG. 4. The grounding receptacle 18 can be a semi-circular piece positioned approximately in the center of the head section 11, as shown in FIG. 6.

The head 11 includes a substantially rectangular upper portion 13 and a substantially rectangular base portion 15 extending substantially perpendicularly from the upper portion 13, as shown in FIGS. 2 and 3. As such, the head section 11 is substantially L-shaped, as shown in FIGS. 2 and 3. The base portion defines a rectangular shaped cavity, as shown in FIGS. 5, 6 and 8.

Figure 8:
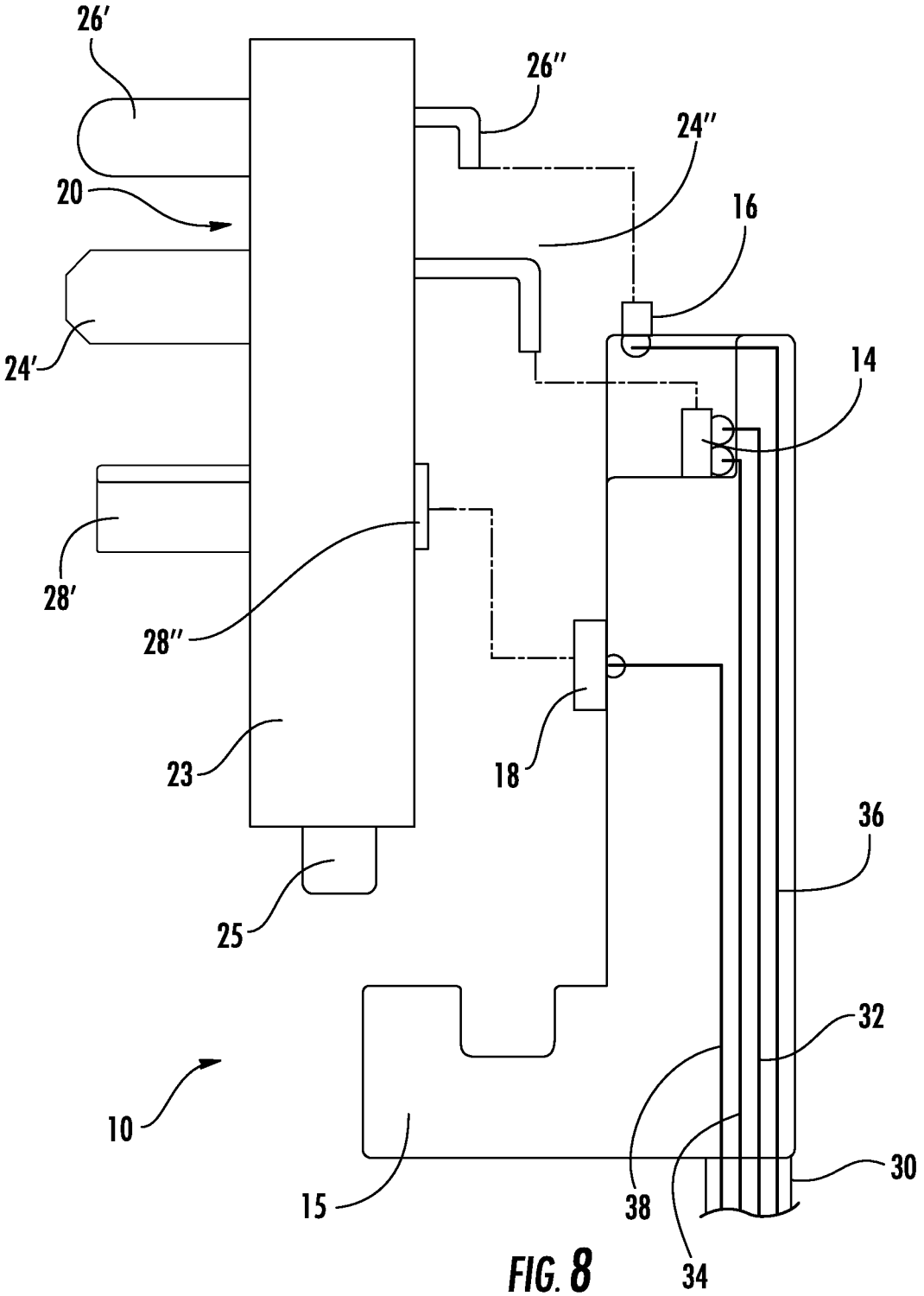
FIG. 8 is a side schematic view of the power cord apparatus of FIG. 1A.

As shown in FIG. 8, the four wires 32, 34, 36, 36 extend from the receptacles 12, 14, 16, 18, respectively, downward within the interior of the head section 11 and through an opening in the base portion 15 of the head section 11. The four wires 32, 34, 36, 36 can be enclosed in a single layer of insulator material to form a power cord 30, as shown in FIGS. 4 and 8.

The face section 20 includes a rectangular shaped body portion 23 having four conductor prongs 22, 24, 26, 28 mounted therein, as shown in FIGS. 1A, 5, 7 and 8. The prongs 22, 24, 26, 28 are comprised of a conductive material, such as metal. Two prongs 22, 24 are power (hot) prongs, one prong 26 is a neutral prong, and another prong 28 is an equipment grounding prong.

Figure 5:
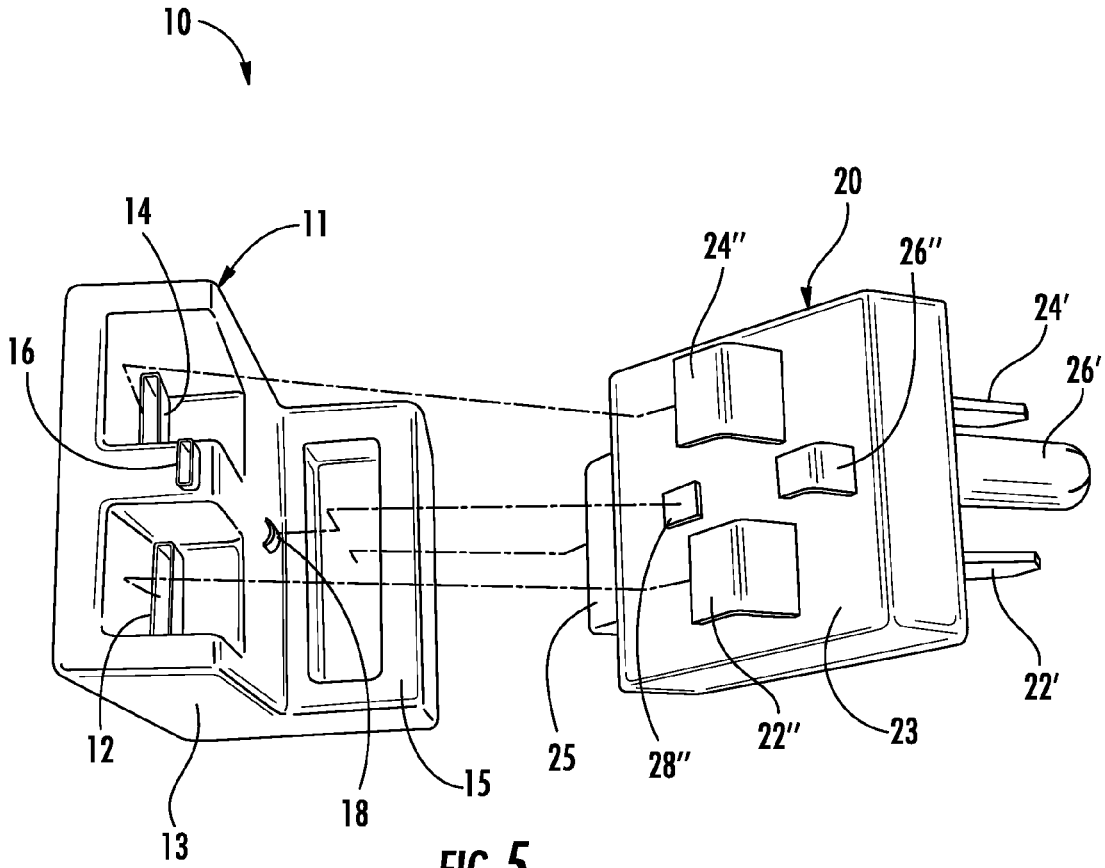
FIG. 5 is another perspective view of the power cord apparatus of FIG. 1A.
Figure 7:
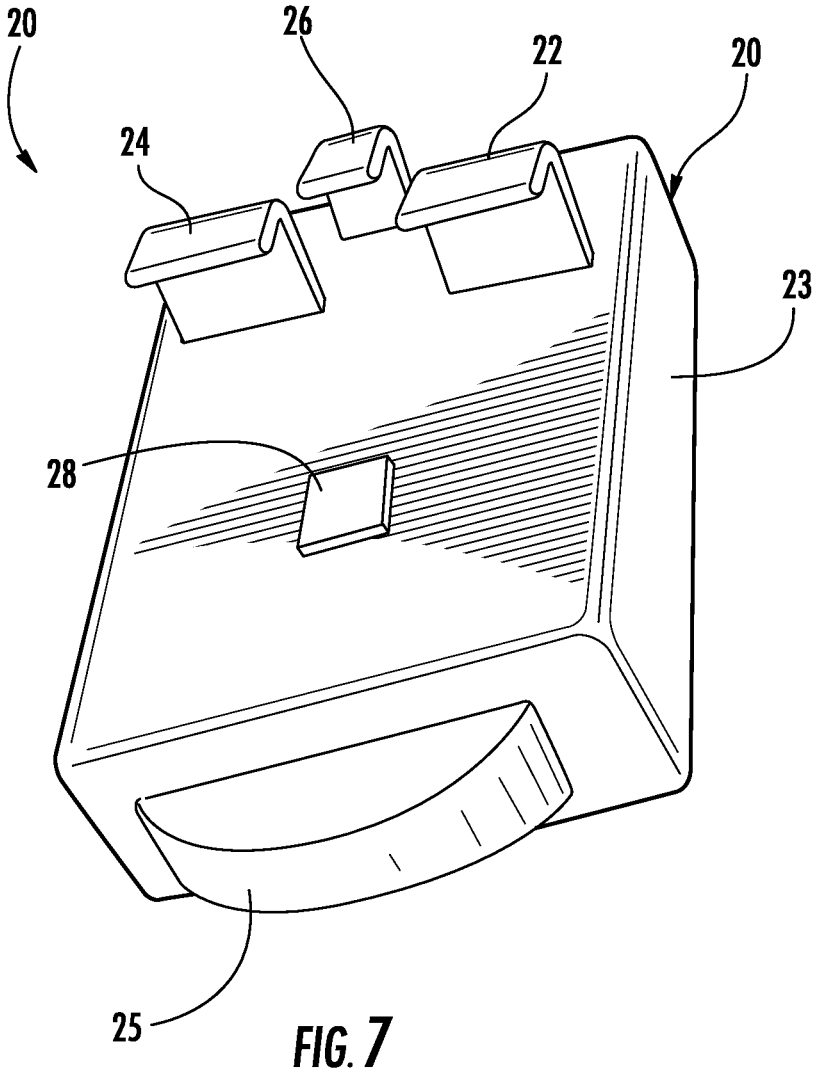
FIG. 7 is another partial perspective view of the power cord apparatus of FIG. 1A.
Figure 9:
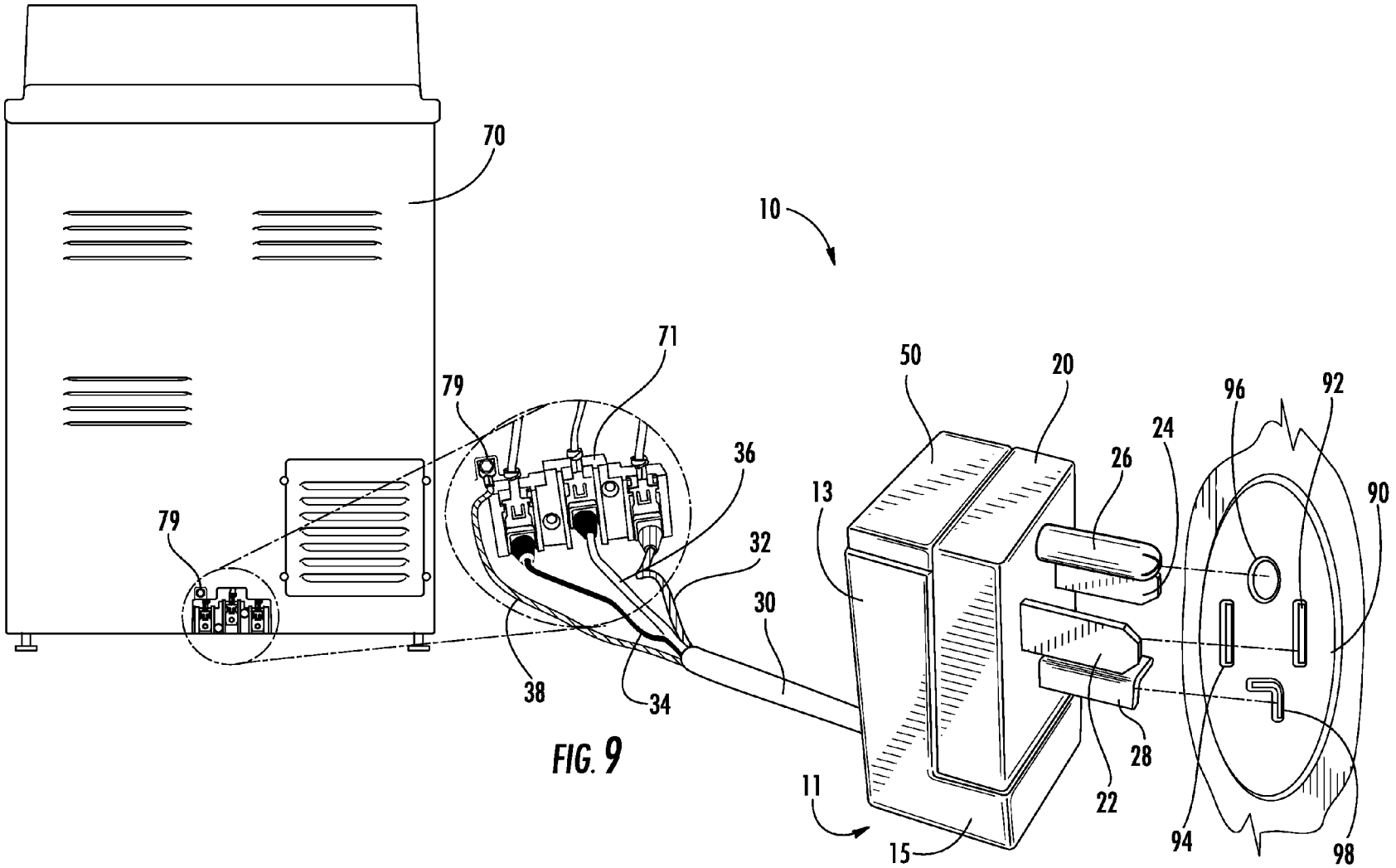
FIG. 9 is an environmental perspective view of the power cord apparatus of FIG. 1A.

As shown in FIGS. 2, 3 and 5, the power prongs 22, 24 include outlet sections 22', 24', respectively, that are shaped and sized to be inserted into the hot slots 92, 94 of a four slot electrical outlet 90, as shown in FIG. 9. As shown in FIGS. 5 and 7, the power prongs 22, 24 also include mating sections 22", 24", respectively, extending through the opposite side of the face section 20 that are shaped and sized to be inserted into and engage the hot receptacles 12, 14 of the head section 11. The mating sections 22", 24" of the power prongs 22, 24 can be substantially L-shaped as shown in FIG. 7.

The neutral prong 26 includes an outlet section 26' that is shaped and sized to be inserted into the neutral slot 96 of the electrical outlet 90, as shown in FIG. 9. As shown in FIGS. 5 and 7, the neutral prong 26 also includes a mating section 26" extending through the opposite side of the face section 20 that is shaped, sized and positioned to be inserted into and engage the neutral receptacle 16 of the head section 11. The mating section 26" of the neutral prong 26 can be substantially L-shaped as shown in FIG. 7.

The equipment grounding prong 28 includes an outlet section 26' that is shaped and sized to be inserted into the grounding slot 98 of the electrical outlet 90, as shown in FIG. 9. As shown in FIGS. 5 and 7, the grounding prong 28 also includes a mating section 28" extending through the opposite side of the face section 20 that is shaped, sized and positioned to contact and engage the grounding receptacle 16 of the head section 11.

The face section 20 includes a base member 25 extending downward from the bottom edge of the body portion 23, as shown in FIG. 7. The base member 25 can have a substantially semi-circular shape, as shown in FIG. 7.

The face section 20 can be releasably connected to the head section 11 by inserting the mating sections 22", 24", 26" of the conductor prongs 22, 24, 26 of the face section 20 into the conductor receptacles 12, 14, 16, respectively, on the head section 11, as shown in FIGS. 5 and 8. As such, the conductor prongs 22, 24, 26, 28 are operatively engaged with the receptacles 12, 14, 16, 18, respectively, and as such electrical current can flow between the prongs 22, 24, 26, 28 and the receptacles 12, 14, 16, 18 when the outlet sections 22', 24', 26', 28' of the prongs 22, 24, 26, 28 are plugged into the electrical outlet 90. The base member 25 of the face section 20 is received in the cavity of the base portion of the head section 11 to provide support to the face section 20 and provide stability when the face section 20 is mated with the head section 11.

Figure 12:
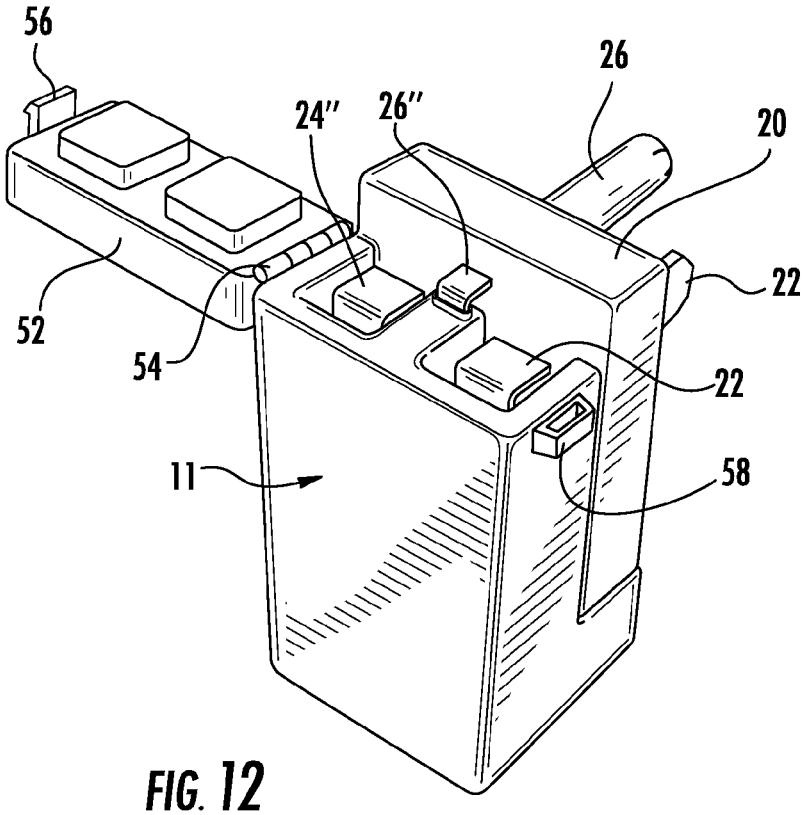
FIG. 12 is a perspective view of a power cord apparatus according to a preferred embodiment of the invention.
Figure 13:
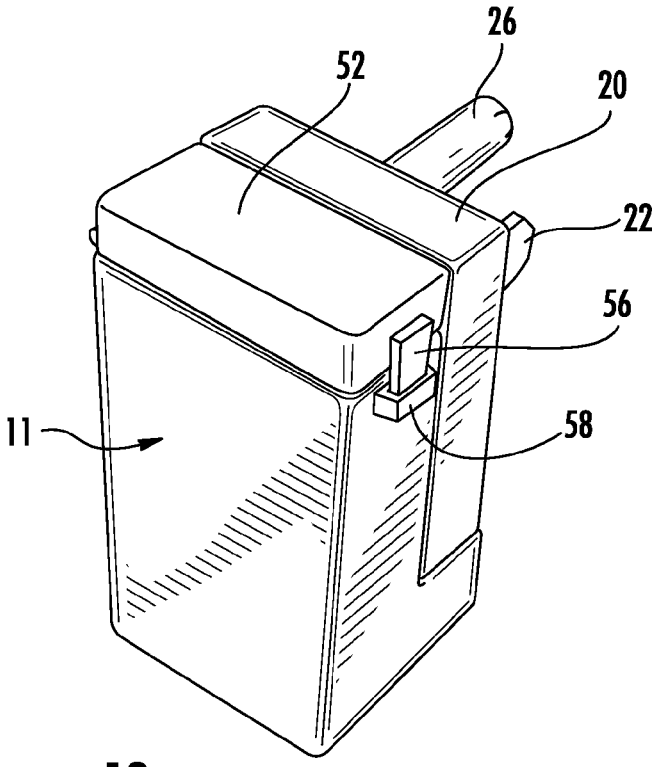
FIG. 13 is another perspective view of the power cord apparatus of FIG. 12.

As shown in FIG. 4, a top panel 50 can be positioned over the receptacles 12, 14, 16 of the head section 11. In an alternative embodiment shown in FIGS. 12 and 13, a top panel 52 is connected at one end to the head section 11 by a hinge 54, and has a clip member 56 attached at the opposite end for engaging a rubber seam 58 attached to the head section 11. As such, the top panel 52 can be pivoted from an open position shown in FIG. 12, to a closed position shown in FIG. 13, and locked into place by inserting the clip member 56 into the rubber seam 58, as shown in FIG. 13.

The face section 20 can be easily disengaged from the head section by removing the top panel 50 and lifting the face section 20 upward to remove the prongs 22, 24, 26 from the receptacles 12, 14, 16, respectively, on the head section 11.

Figure 10:
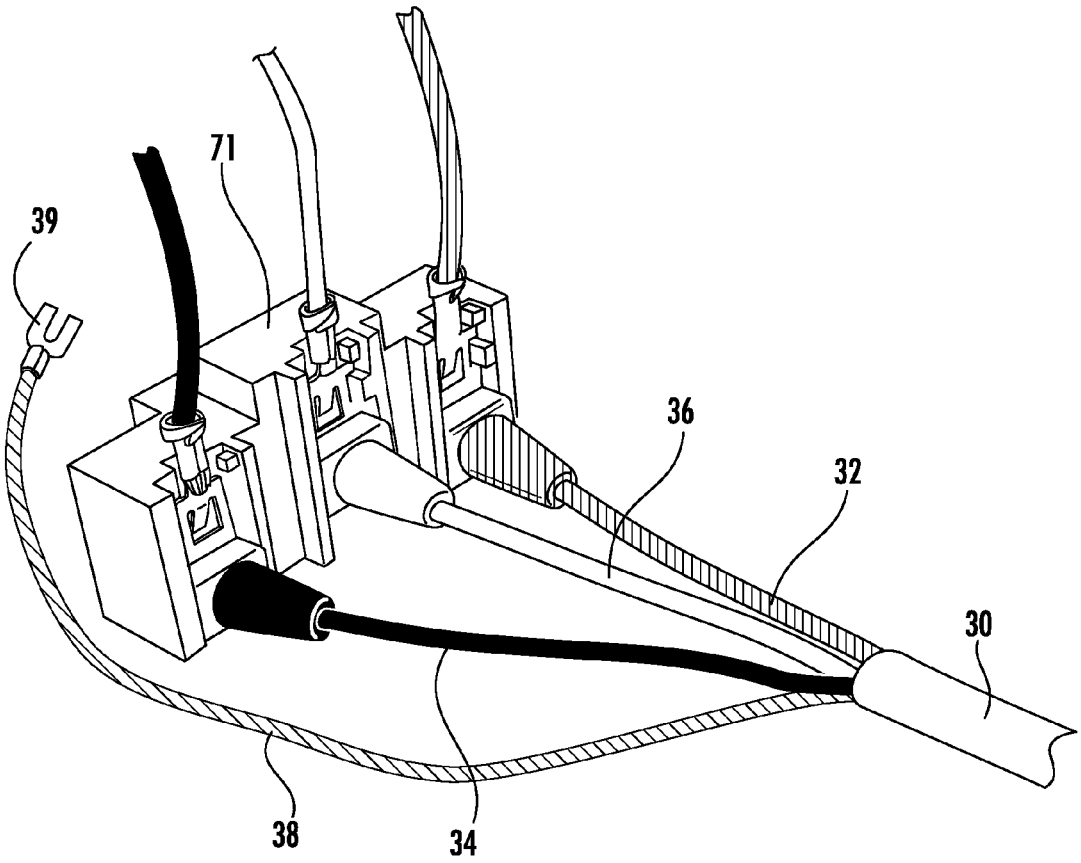
FIG. 10 is a partial environmental perspective view of the power cord apparatus of FIG. 1A.
Figure 11:
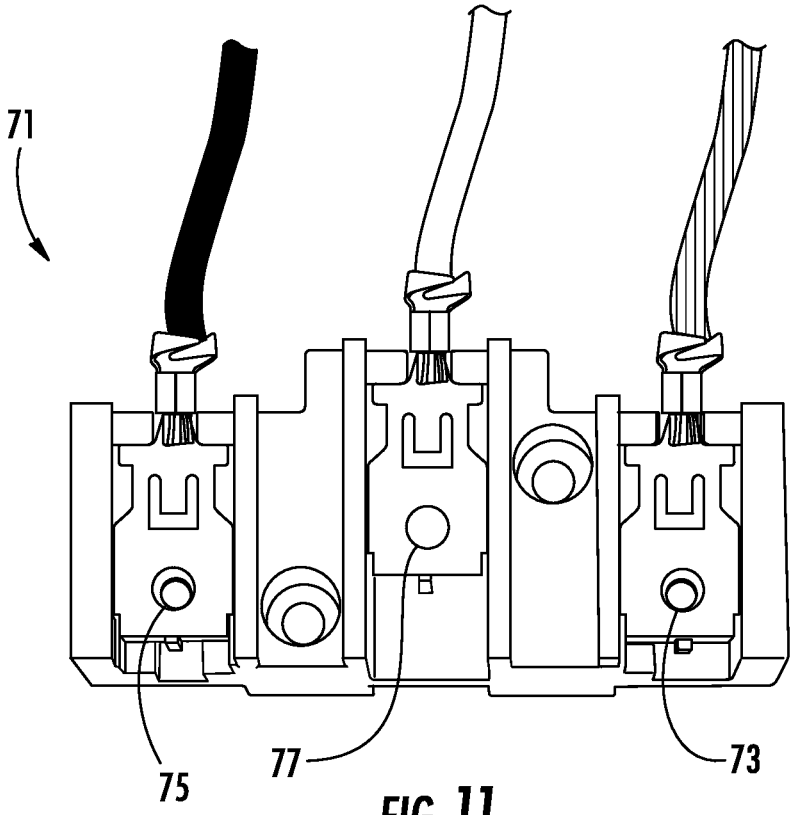
FIG. 11 is a perspective view of an appliance power block.

As shown in FIG. 4, the wires 32, 34, 36, 36 have engagement sections 33, 35, 37, 39, respectively, for operatively connecting to the load. As shown in FIGS. 9 and 10, the engagement sections 33, 35, 37, 39 can be adapted for engaging the power block 71 of the dryer 70. As shown in FIG. 4, the engagement sections 33, 35, 37 of the hot and neutral wires 32, 34, 36 can comprise round male members that are shaped and sized to be inserted into the corresponding orifices 73, 75, 77 of the power block 71, as shown in FIGS. 9-11. Alternatively, the engagement sections 33, 35, 37 of the hot and neutral wires 32, 34, 36 can have a female construction, in which the engagement sections accept the male threaded screws that attach the wires 32, 34, 36 to the to the power block 71. The engagement section 39 of the grounding wire 38 comprises a U-shaped member for attaching to the grounding receptacle 79 on the dryer 70. Preferably, the grounding wire 38 has a substantially flat surface, and extends approximately three inches longer than the other wires 32, 34, 36. The grounding wire 38 can include an adhesive strip for attaching the wire 38 to the metal surface of the dryer 70, or other appliance such as a stove.

The power cord apparatus 10 can include a plurality of face sections having different prong configurations corresponding to different outlet configurations. As illustrated in FIGS. 1A, 1B, 1C and 1D, power cord apparatus 10 can include four different face sections 20, 20B, 20C, 20D that are adapted for use with the four different electrical outlets typically used with electric dryers.

FIGS. 1A and 1B illustrate face sections 20, 20B, respectively, having prong configurations for use with the two predominant four prong outlets used with dryers. Face section 20 is described in detail above. Face section 20B includes two power (hot) prongs 22B, 24B, a neutral prong 26B, and an equipment grounding prong 28B. Face section 20B is identical in structure to previously described face section 20, except for the straight design of the equipment grounding prong 28B of face section 20B. Face section 20B mates with the head section 11 in the same manner as previously described face section 20. That is, the power prongs 22B, 24B are received in the hot receptacles 12, 14 of the head section 11, the neutral prong 26B is received in the neutral receptacle 16, and the grounding prong 28B contacts the grounding receptacle 18.

FIGS. 1C and 1D illustrate face sections 20C and 20D, respectively, having prong configurations for use with the two predominant three prong outlets used with dryers. The three prong face sections 20C, 20D are similar in construction as previously described four prong face sections 20, 20B, except that the three prong face sections 20C, 20D do not include an equipment grounding prong as that is not needed for the three prong outlets. As such, face sections 20C, 20D mate with the head section 11 in the same manner as face section 20, except that there is no grounding prong to contact the grounding receptacle 18 of the head section 11.

Face section 20C includes two power (hot) prongs 22C, 24C, and a neutral prong 26C, as show in FIG. 1C. Face section 20D includes two power (hot) prongs 22D, 24D, and a neutral prong 26D, as show in FIG. 1D. Face section 20D is identical in structure to face section 20C, except for the straight design of the neutral prong 26D of face section 20D.

The multiple face sections 20, 20B, 20C, 20D enable the power cord apparatus 10 to be used with all four dryer outlet configurations. For example, the dyer 70 may be initially installed at a location utilizing face section 20C in a corresponding three prong outlet, but later moved to a different location having the four prong outlet 90 shown in FIG. 9. As such, the face section 20C can be removed from the head section 11, and replaced with the appropriate face section 20 to engage the four prong outlet 90.

Because the multiple face sections 20, 20B, 20C, 20D allow for use of the power cord apparatus 10 in all four dryer outlet designs, the power cord 30 and the head section 11 can be manufactured and sold as an integral piece of the dryer 70, and the four face sections 20, 20B, 20C, 20D can be sold along with the dyer 70, thereby eliminating the need to dryer power cords separately from the dryer. Alternatively, the power cord 30 and the head section 11 can be manufactured and sold as an integral piece of the dryer 70, and the four face sections 20, 20B, 20C, 20D can be sold separately, either in a single package containing all four face sections 20, 20B, 20C, 20D, or in separate packages containing only one of the face sections 20, 20B, 20C, 20D. In yet another embodiment of the invention, the power cord apparatus 10 comprised of the power cord 30, the head section 11 and the face sections 20, 20B, 20C, 20D can be packaged together in a single kit to be sold separately from the dryer 70.

A power cord apparatus and method of using same are described above. Various changes can be made to the invention without departing from its scope. The above description of preferred embodiments and best mode of the invention are provided for the purpose of illustration only and not limitation—the invention being defined by the claims and equivalents thereof.

What is claimed is:

1. A power cord adapter apparatus comprising:

(a) a face section;

(b) at least one power prong carried on the face section, the at least one power prong comprising a first section adapted for insertion into a hot slot of an electrical outlet, and a second section adapted for engaging a complimentary member operatively connected to a hot wire of an electrical cord; and (c) a neutral prong carried on the face section, the neutral prong comprising a first section adapted for insertion into a neutral slot of an electrical outlet, and a second section adapted for engaging a complimentary member operatively connected to a neutral wire of an electrical cord; and (d) a head section comprising:

(i) at least one hot receptacle adapted for receiving the second section of the at least one power prong and operatively connected to a hot wire of an electrical cord, (ii) a neutral receptacle adapted for receiving the second section of the neutral prong and operatively connected to a neutral wire of an electrical cord, and (iii) wherein the head section includes an upper portion and a base portion extending substantially perpendicularly from the upper portion, and further wherein the at least one hot receptacle and the neutral receptacle are positioned in the upper portion.

2. The apparatus according to claim 1, further comprising a grounding prong carried on the face section, the grounding prong comprising a first section adapted for insertion into a grounding slot in an electrical outlet, and a second section adapted for engaging a complimentary member operatively connected to a ground wire of an electrical cord.

3. The apparatus according to claim 1, wherein the at least one power prong comprises two power prongs carried on the face section, and each of the two power prongs include a first section adapted for insertion into a hot slot of an electrical outlet, and a second section adapted for engaging a complimentary member operatively connected to a hot wire of an electrical cord.

4. The apparatus according to claim 3, wherein the two power prongs are positioned on the face section above the neutral prong, and the apparatus is adapted for use with a three prong electrical outlet.

5. The apparatus according to claim 3, further comprising a grounding prong carried on the face section, the grounding prong comprising a first section adapted for insertion into a grounding slot in an electrical outlet, and a second section adapted for engaging a complimentary member operatively connected to a ground wire of an electrical cord, wherein the apparatus is adapted for use with a four prong electrical outlet.

6. The apparatus according to claim 5, wherein the neutral prong is positioned on the face section above the two power prongs.

7. The apparatus according to claim 6, wherein the two power prongs are positioned on the face section above the grounding prong.

8. The apparatus according to claim 5, wherein the first body section is substantially flat and has first and second opposed sides, and further wherein the power prongs, the neutral prong and the grounding prong extend through the face section, and the first sections of the power prongs, the neutral prong and the grounding prong extend outward from the first side of the face section and the second sections of the power prongs, the neutral prong and the grounding prong extend outward from the second side of the face section.

9. A power cord kit comprising:

(a) first and second face sections, each of the first and second face sections comprising:

(i) at least one power prong comprising a first section adapted for insertion into a hot slot of an electrical outlet, and a second section adapted for engaging a complimentary member operatively connected to a hot wire of an electrical cord, and (ii) a neutral prong comprising a first section adapted for insertion into a neutral slot of an electrical outlet, and a second section adapted for engaging a complimentary member operatively connected to a neutral wire of an electrical cord; and (b) a head section comprising:

(i) at least one hot receptacle adapted for receiving the second section of the at least one power prong and operatively connected to a hot wire of an electrical cord, (ii) a neutral receptacle adapted for receiving the second section of the neutral prong and operatively connected to a neutral wire of an electrical cord, and (iii) wherein the head section includes an upper portion and a base portion extending substantially perpendicularly from the upper portion, and the at least one power receptacle and the neutral receptacle are positioned in the upper portion.

10. The apparatus according to claim 1, further comprising a grounding prong carried on the face section, the grounding prong comprising a first section adapted for insertion into a grounding slot in an electrical outlet, and a second section adapted for engaging a complimentary member operatively connected to a ground wire of an electrical cord, and wherein the head section comprises a grounding receptacle operatively connected to a ground wire of an electrical cord and adapted for receiving the second section of the grounding prong.

11. The apparatus according to claim 10, wherein the at least one power prong comprises first and second power prongs carried on the face section, wherein each of the first and second power prongs include a first section adapted for insertion into a hot slot of an electrical outlet, and a second section adapted for engaging a complimentary member operatively connected to a hot wire of an electrical cord, and further wherein the at least one hot receptacle comprises first and second hot receptacles, the first hot receptacle adapted for receiving the second section of the first power prong and the second hot receptacle adapted for receiving the second section of the second power prong.

12. The power cord kit according to claim 9, wherein first face section is adapted for engaging a three prong electrical outlet.

13. The apparatus according to claim 1, wherein the face section includes a substantially rectangular upper portion and a base member extending downwardly from a lower edge of the upper portion, and further wherein the base portion of the head section includes a cavity shaped and sized to receive the base member of the first body section therein, whereby the head section supports the face section.

14. The power cord kit according to claim 12, wherein the second face section is adapted for engaging a four prong electrical outlet.

* * * * *